US009488448B2

(12) United States Patent
Weber et al.

(10) Patent No.: US 9,488,448 B2
(45) Date of Patent: Nov. 8, 2016

(54) PROTECTION EQUIPMENT, VEHICLE AND METHOD FOR PROTECTING A TARGET

(71) Applicant: KRAUSS-MAFFEI WEGMANN GMBH & CO. KG, München (DE)

(72) Inventors: Jürgen Weber, Brühl (DE); Günter Rettinger, München (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 0 days.

(21) Appl. No.: 14/416,135

(22) PCT Filed: Jul. 19, 2013

(86) PCT No.: PCT/DE2013/100268
§ 371 (c)(1),
(2) Date: Jan. 21, 2015

(87) PCT Pub. No.: WO2014/015857
PCT Pub. Date: Jan. 30, 2014

(65) Prior Publication Data

US 2015/0184980 A1 Jul. 2, 2015

(30) Foreign Application Priority Data

Jul. 25, 2012 (DE) ..... 10 2012 106 746

(51) Int. Cl.
*F41H 5/007* (2006.01)
*F41H 11/02* (2006.01)

(52) U.S. Cl.
CPC ..... *F41H 5/007* (2013.01); *F41H 11/02* (2013.01)

(58) Field of Classification Search
CPC ..... F41H 5/007; F41H 5/16; F41H 11/02; F41H 11/00; F41H 11/04
USPC ..... 89/28.1, 28.2, 37.15, 36.17, 36.01; 102/438
See application file for complete search history.

(56) References Cited

U.S. PATENT DOCUMENTS 6,128,999 A 10/2000 Sepp et al.
6,279,449 B1 8/2001 Ladika et al.
(Continued)

FOREIGN PATENT DOCUMENTS

DE 2612673 C1 1/1998
DE 3804991 C1 7/1999
(Continued)

OTHER PUBLICATIONS

PCT, International Search Report (with English language translation), PCT/DE2013/100268 (Oct. 16, 2013).
(Continued)

*Primary Examiner* — John D Cooper
(74) *Attorney, Agent, or Firm* — Thompson Hine LLP

(57) ABSTRACT

Protection equipment (10) for protecting a target (1) against attacking missiles with a plurality of protection elements (11, 12) that are triggerable individually in order to combat a missile, wherein the protection elements (11, 12) are arranged in such a manner that a triggered protection element (11) may be replaced by a replacement protection element (12) arranged redundantly in relation to the former. The protection equipment may be associated with a vehicle (1). The disclosure includes a method for protecting a target (1) against attacking missiles using the disclosed protection equipment.

15 Claims, 7 Drawing Sheets

(56) References Cited

U.S. PATENT DOCUMENTS

| | | | | |
|---|---|---|---|---|
| 6,327,955 | B1 * | 12/2001 | Kerdraon | F41H 5/007 89/36.17 |
| 6,782,793 | B1 * | 8/2004 | Lloyd | F41H 5/007 89/36.17 |
| 2006/0107829 | A1 * | 5/2006 | Shumov | F41H 11/02 89/36.08 |
| 2006/0169832 | A1 * | 8/2006 | Glasson | F41H 11/04 244/3.1 |
| 2012/0011996 | A1 * | 1/2012 | Glasson | F41H 11/04 89/36.17 |
| 2013/0092016 | A1 * | 4/2013 | Sales | F41H 5/007 89/36.08 |
| 2013/0125656 | A1 * | 5/2013 | Tillotson | F41H 5/007 73/599 |
| 2014/0102288 | A1 * | 4/2014 | Yeshurun | F41H 5/007 89/36.17 |
| 2014/0138474 | A1 * | 5/2014 | Sharpin | F41H 11/02 244/3.22 |

FOREIGN PATENT DOCUMENTS

| | | | | |
|---|---|---|---|---|
| DE | 19754936 | A1 | 7/1999 | |
| DE | 10230939 | A1 | 2/2004 | |
| DE | 3642197 | A1 | 2/2009 | |
| EP | 1467171 | A1 | 10/2004 | |
| FR | 2936046 | A1 | 3/2010 | |
| GB | DE 3642197 | A1 * | 2/2009 | F41H 5/007 |
| UA | EP 1467171 | A1 * | 10/2004 | F41H 5/007 |

OTHER PUBLICATIONS

DE 2612673 C1, published Jan. 1998, English language abstract.
DE 3642197 A1, published Feb. 2009, English language abstract.
DE 3804991 C1, published Jul. 1999, English language abstract.
DE 10230939 A1, published Feb. 2004, English language abstract.
DE 19754936 A1, published Jul. 1999, English language abstract.
FR 2936046 A1, published Mar. 2010, English language abstract.

* cited by examiner

Fig. 7
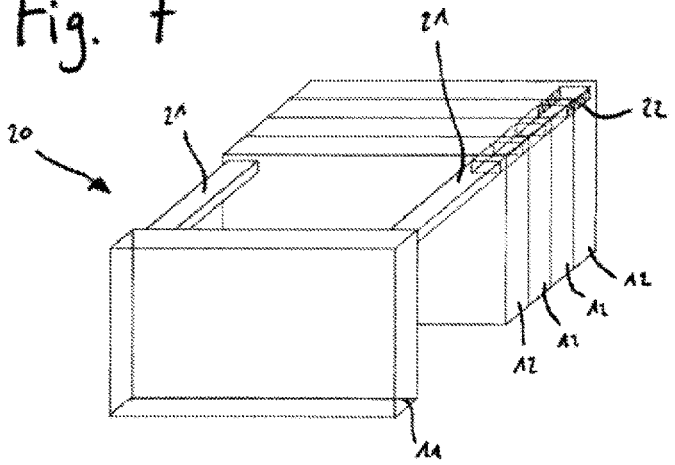
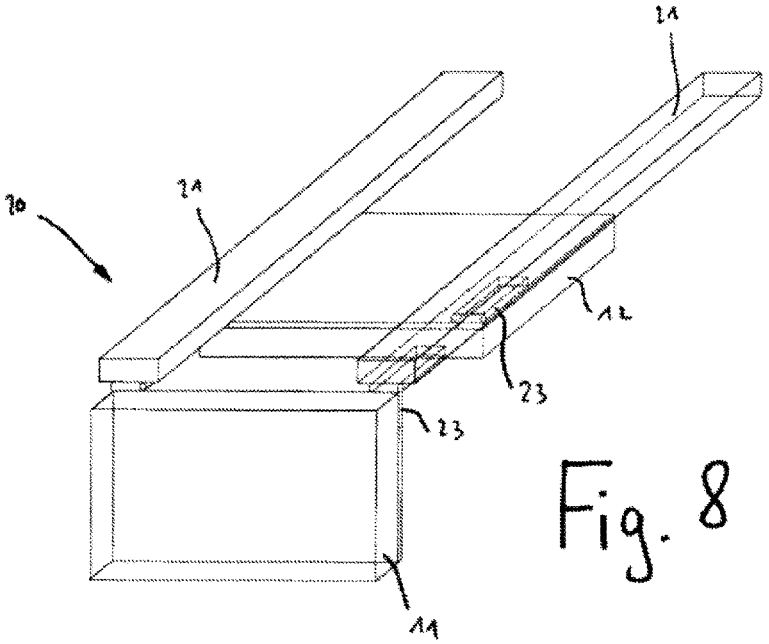
Fig. 8

PROTECTION EQUIPMENT, VEHICLE AND METHOD FOR PROTECTING A TARGET

TECHNICAL FIELD

The disclosure relates to protection equipment and methods for protecting a target attacking missiles, and more particularly, equipment and method for protecting vehicles, for example a military vehicle, from attacking missiles, in which protection elements, are triggered individually to combat the missile.

BACKGROUND

To protect various targets, such as for example vehicles, ships, bunkers or similar targets, against attacking missiles, use is often made of versions of protection equipment that have a number of protection elements which can be used optionally for combating the incoming missile.

German published patent specification No. DE 26 12 673 C1 discloses protection elements that can be triggered as and when required to combat an incoming missile, such as for example a hollow-charge projectile. The protection element has for this purpose a multiplicity of interceptor explosive charges, which can be triggered individually or in groups.

It has been found to be disadvantageous in the case of protection equipment with such protection elements that, although it offers good protection against a first incoming missile, under some circumstances a second missile approaching from the same direction is no longer intercepted, since the corresponding interceptor explosive charges have already been triggered to combat the first missile.

SUMMARY

Against this background, an object of the disclosed protection equipment is to provide improved protection against multi-hits.

In the case of protection equipment of the type mentioned at the beginning, this object is achieved in that the protection elements are arranged in such a way that a triggered protection element is replaced by a replacement protection element arranged redundantly in relation to it.

Such an arrangement of the protection elements and of the corresponding replacement protection elements achieves reliable protection of the target even upon multi-hits from the same direction. This is so because the protective function of the triggered protection element is taken over by the replacement protection element arranged redundantly in relation to it. The replacement of the triggered protection element by the replacement protection element is performed automatically, so that it is not required to carry out any manual actions for the replacement.

An advantageous design of the invention provides that the direction of effect of the protection elements is directed downwardly, preferably vertically downwardly. On account of the downwardly directed direction of effect, the risk of collateral damage when triggering of the protection element takes place is minimized. The protection elements may be arranged in the upper end region of the target to be protected, for example in the roof region of a vehicle, and act downwardly against the attacking missile. To this extent, the protection elements are primarily suitable for combating missiles approaching the target from the side that can be combated transversely in relation to their direction of flight.

A further design provides that a number of protection elements are arranged in the form of a ring, in particular in the manner of a closed or open ring. The arrangement of the protection elements in the form of a ring provides protection of the target to be protected that is effective on all sides. The arrangement of the protection elements in the form of a ring can bring about seamless protection of the target to be protected.

A further design provides that the protection elements have a number of explosive charges that can be triggered together, in particular in the form of hollow charges, plane charges, cutting charges or projectile-forming charges. All of the explosive charges of a protection element can be triggered together. Arranging the explosive charges next to one another achieves combating of the attacking missile over a broad range, so that there is a high probability of it being rendered harmless.

A further design provides that the replacement protection element is arranged in such a way that various protection elements can be replaced by it or that it is permanently assigned to one protection element as a replacement. In the case of an embodiment in which various protection elements can be replaced by means of a single replacement protection element, there is the advantage that even a relatively small number of replacement protection elements is sufficient to obtain redundant protection in each case for the protection elements triggered, which allows an altogether low-cost construction. In the case of a design in which the replacement protection elements are permanently assigned to the triggered protection element as a replacement, a simple construction is obtained. However, in this case it is necessary that the number of replacement protection elements coincides with the number of protection elements.

A design that is structurally advantageous, by virtue of being simple, provides that the replacement protection element is arranged behind the triggered protection element. When looked at in the direction of the threat, a kind of series arrangement of the protection elements is obtained. Firstly, the outer protection element is triggered, then the replacement protection element that is arranged behind the triggered protection element is transformed from an inactive state to an active state and can take over the function of the triggered protection element. A missile approaching the target once again from the same direction after the corresponding protection element has already been triggered can therefore be combated by the replacement protection element.

In this connection, it has also proven to be advantageous if the protection elements are fixedly arranged and the replacement protection element is movably arranged. The movable arrangement of one or more replacement protection elements makes it possible that various protection elements can be replaced by a replacement protection element after they have been triggered. The gaps produced by triggering the outer protection elements can be closed by the replacement protection elements arranged behind them, as it were in the second row.

In certain structural situations, a design that may be advantageous in which a number of replacement protection elements are provided, at least one of which is fixedly arranged and one of which is movably arranged. In regions of the protection arrangement into which the replacement protection element cannot be readily moved, the replacement protection elements may be fixedly arranged. In regions with easier accessability, they may be movably arranged.

In addition, it is proposed that means for moving the replacement protection elements are provided. The moving means may be activated by way of a motive drive, for example an electromotive drive. The means for moving the replacement protection elements may for example have a cantilever arm, at the free end of which at least one protection element is arranged, wherein the cantilever arm can for example be rotatably articulated about a substantially vertically extending axis on the target to be protected.

A further design of the protection arrangement provides that, when providing a replacement, the replacement protection element assumes the position of the triggered protection element. An arrangement in which the replacement protection element assumes the position of the triggered protection element when providing a replacement offers the advantage over such a design in which the replacement protection element is arranged behind the triggered protection element that the distance between the protection element or replacement protection element and the target to be protected does not change when the replacement is provided.

It has proven to be advantageous in this connection if the protection element and a replacement protection element, preferably three replacement protection elements, are arranged in a rotary drum that is preferably rotatable about a horizontal axis of rotation. With such an arrangement, a replacement of the triggered protection element can be achieved in a way that is structurally comparatively simple. In the case of three replacement protection elements, incremental turning of the rotary drum allows the achievement of a triply redundant arrangement, in which, after triggering of the protection element, altogether three replacement protection elements can be moved one after the other into the position of the triggered protection element by rotational movements of the rotary drum by 90 degrees in each case.

To avoid unwanted instances of external triggering, for example by being fired on or similar effects, it is also proposed in this connection that the rotary drum has a covering with an active opening. The covering may enclose the rotary drum in the manner of a cylindrical shell and consist of a ballistically resistant material, for example armor steel. In the direction of effect of the protection element, the covering may have an active opening, through which the respectively triggered protection element acts outwardly against the attacking missile.

A further design provides that the protection element and at least one replacement protection element are arranged one behind the other in a magazine. The arrangement one behind the other in a magazine allows a triggered protection element to be replaced with a replacement element by a reloading operation. A number of replacement protection elements, for example two, three, four, five or more, may be arranged in the magazine.

Finally, it is proposed that, for replacing the protection element, the replacement protection element can be transferred from a rearward magazine position into a forward magazine position, preferably by an axial or folding movement.

In the case of a vehicle of the type mentioned at the beginning, it is proposed for achieving the aforementioned object that the protection equipment is formed as claimed in one of the preceding claims.

Such protection equipment with the corresponding arrangement of the protection elements and the replacement protection elements achieves reliable protection of the vehicle even upon multi-hits from the same direction. This is so because the protective function of the triggered protection element is taken over by the replacement protection element arranged redundantly in relation to it.

In a design of the vehicle it is also proposed that the protection equipment is arranged on the roof of the vehicle. In this way, reliable combating of missiles approaching from the side can be achieved by the protection elements acting downwardly. The protection equipment is preferably arranged at a certain distance from the roof of the vehicle in the vertical direction, so that even missiles hitting comparatively high up in the side region of the vehicle can be reliably combated.

The protection equipment is preferably arranged at a distance of at least 30 cm, preferably at least 50 cm, and more preferably at least 70 cm, from the roof area of the vehicle.

In the case of a method of the type mentioned at the beginning, it is proposed for achieving the aforementioned object that the triggered protection element is replaced by a protection element arranged redundantly in relation to it.

The replacing of a protection element by a replacement protection element arranged redundantly in relation to it achieves reliable protection of the target even upon multi-hits from the same direction. This is so because the protective function of the triggered protection element is taken over by the replacement protection element arranged redundantly in relation to it. The replacement may take place in an automated manner, without any manual actions having to be carried out for this.

All of the embodiments of the protection equipment that are described above may be used individually or in combination, both with regard to the method and with regard to the vehicle.

BRIEF DESCRIPTION OF THE DRAWINGS

Further details and advantages of the disclosed protection equipment, and of a vehicle equipped with such protection equipment, and of a method for protecting a target against attacking missiles, are explained below with the aid of the accompanying drawings of exemplary embodiments, in each case in schematic views, in which:

FIG. 7 shows an alternative design of the protection equipment in a perspective view; and FIG. 8 shows a view corresponding to the representation in FIG. 7 according to a further alternative design.

DETAILED DESCRIPTION

Figure 1:
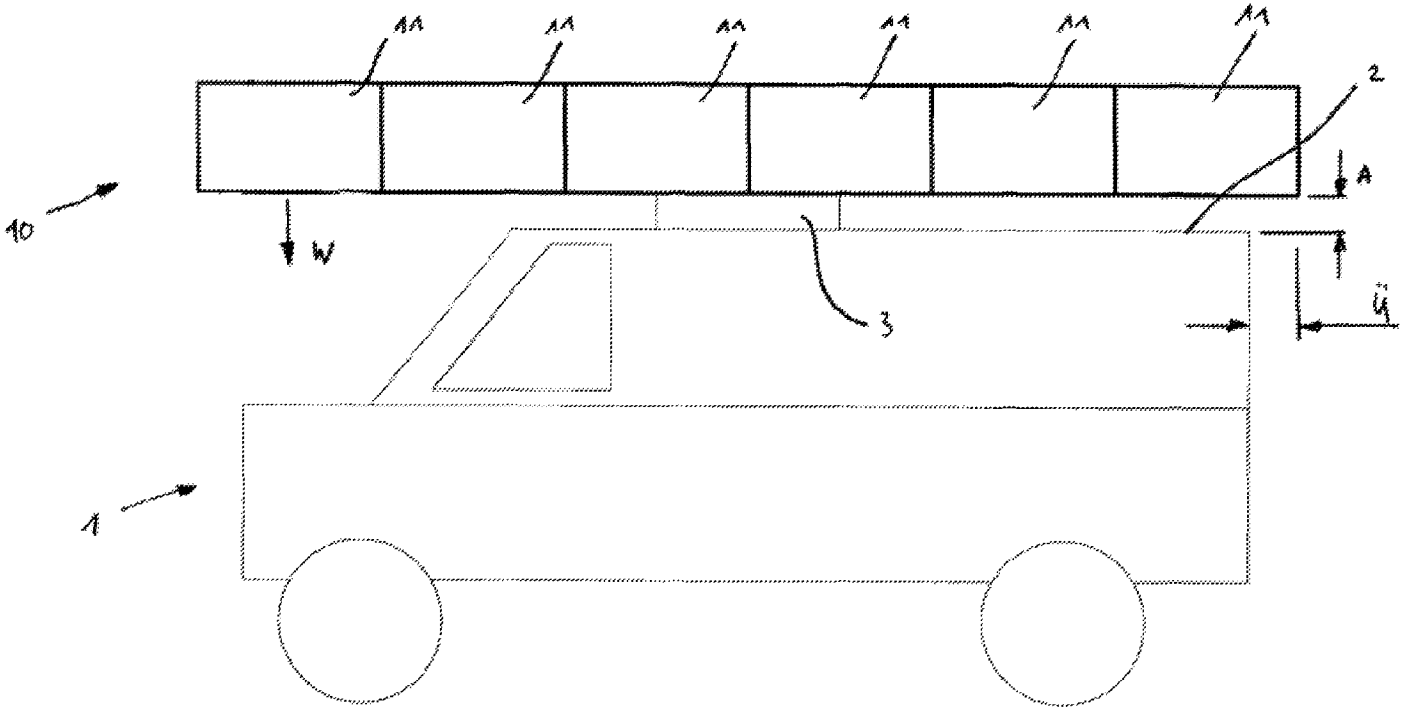
FIG. 1 shows a side elevational view of a vehicle with protection equipment arranged on it.

FIG. 1 shows a side view of a target 1 to be protected, which is a military vehicle. Although a vehicle 1 is shown in each case in the figures of the exemplary embodiments, the invention may equally also be used for protecting other targets 1, such as for example helicopters, ships, buildings, bunkers, bridges, such as for instance temporary bridges laid over relatively long periods of time, or the like.

The vehicle 1 shown in FIG. 1 is a wheeled vehicle designed to be protected against military threats, which is designed for example to be protected against ballistic threats. Apart from ballistic threats, in practice problems are especially presented by missiles in the form of hollow-charge projectiles, which are fired for example with a bazooka, since these penetrate the basic armor plating of the vehicles 1 that is conventionally provided to provide protection against ballistic threats.

Therefore, to provide protection against such missiles, protection equipment 10 is provided, the specific details of which are discussed below.

As the representation in FIG. 1 firstly reveals, the protection arrangement 10 consists of a multiplicity of protection elements 11, 12 in the form of plates, which are arranged in the roof region of the vehicle 1. For this purpose, the protection equipment 10 is connected to the vehicle roof 2 of the vehicle 1 by way of a holder 3. Elements in the form of frames or beams, which ensure that the protection equipment 10 is securely held in a position above the roof 2, may be used in particular as holders 3.

As the representation in FIG. 1 also reveals, the protection equipment 10 is arranged at a distance A from the roof 2, whereby it is intended to achieve the effect that missiles hitting comparatively high up, at the upper end of the side walls of the vehicle 1, can be reliably combated. As the representation also reveals, provided to the side there is also a projection Ü, which ensures that the attacking missile is combated at a certain distance from the vehicle 1.

For combating a missile, the individual protection elements 11, 12 respectively have a number of explosive charges that can be triggered together, for example a number of explosive charges in the form of miniature hollow charges. Alternatively, plane charges, cutting charges or projectile-forming charges could also be provided, depending on which type of missile is to be combated. The number of explosive charges provided per protection element 11, 12 may be in the range of four to twenty charges, particularly solutions with eight to twelve explosive charges in the form of hollow charges having proven to be advantageous.

The explosive charges can be ignited at the same time by way of a common ignition distributor. Igniting the explosive charges or triggering the protection element 11 produces an effect acting in the direction of effect W that is directed downwardly, substantially parallel to the side surface of the vehicle 1. Since the protection elements 11 are arranged on the roof 2 of the vehicle in the manner of a ring (cf. also the representation in FIG. 2), a protective surface surrounding the vehicle 1 in the manner of a protective curtain is obtained, combating these penetrating missiles by triggering a protection element 11 that is respectively located above the missile.

By triggering the protection elements 11, the missile is destroyed and the fragments of the missile created are intercepted by the basic armor plating of the vehicle 1, whereby reliable protection of the vehicle crew is obtained.

As explained in detail below on the basis of the representations in FIGS. 2 to 8, the arrangement of the protection elements 11, 12 is chosen such that a triggered protection element 11 is automatically replaced by a replacement protection element 12 arranged redundantly in relation to it. This achieves the result that a protective effect that is undiminished in its reliability is maintained even upon multi-hits from the same direction.

Figure 2:
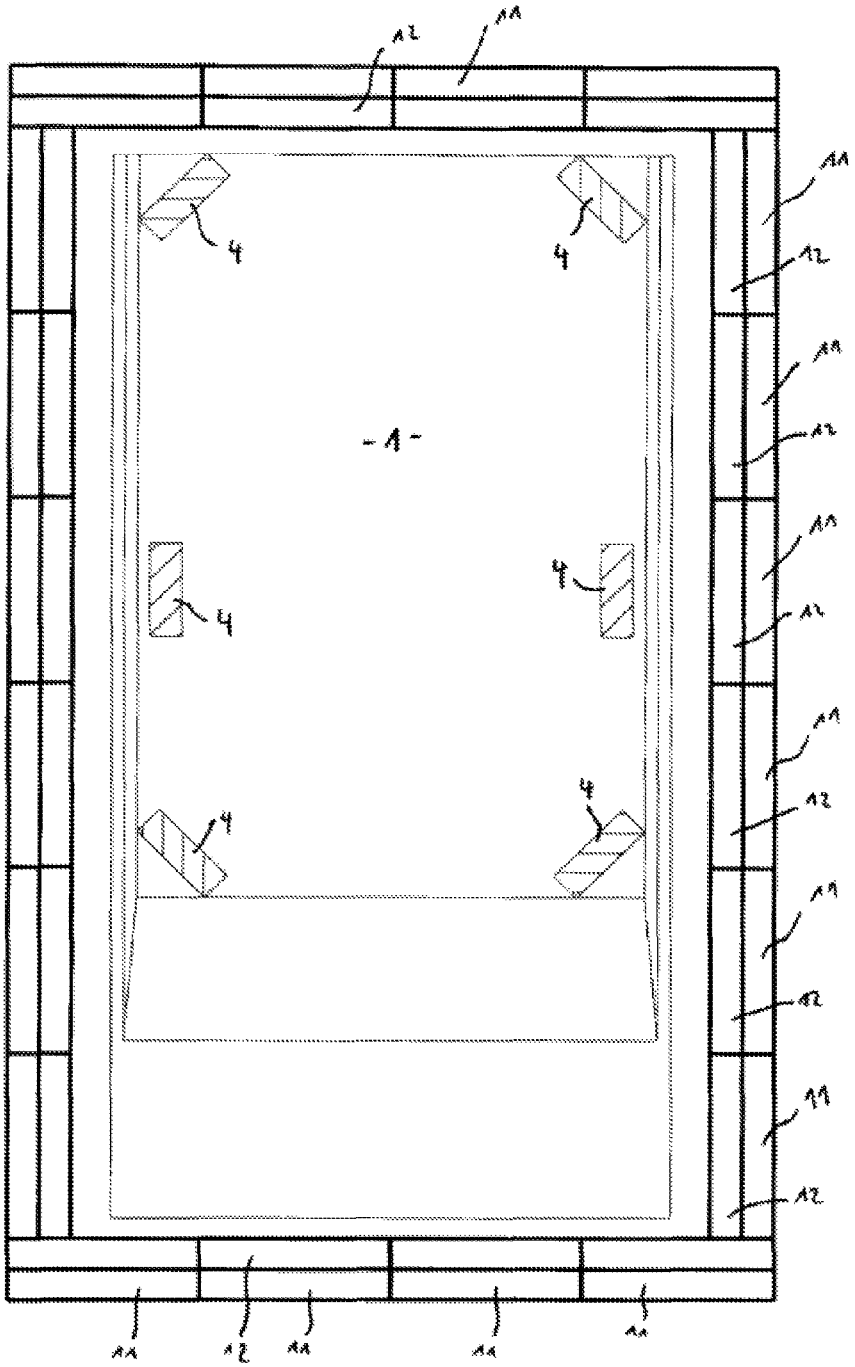
FIG. 2 shows a top plan view of the vehicle according to the representation in FIG. 1.

In the case of the embodiment according to the representation in FIG. 2, the protection elements 11 and also the replacement protection elements 12 are respectively arranged around the vehicle 1 in the form of a ring. A two-row arrangement of the protection elements 11, 12 is obtained. After triggering of a protection element 11, the protective function of the triggered protection element 11 is taken over immediately after its triggering by the replacement protection element 12 arranged behind it. The replacement protection elements 12 are permanently assigned to the protection elements 11 arranged in front of them. The number of replacement protection elements 12 corresponds to the number of protection elements 11.

In normal operation, the replacement protection elements 12 are inactive, so that they cannot be triggered. Immediately after triggering of the protection element 11 lying in front of it has taken place, a replacement protection element 12 is transformed from an inactive state into an active state by way of corresponding electronics, and can then be used for combating a further missile.

On account of the redundant arrangement, the all-round protection for the vehicle 1 is retained even upon multi-hits. Gaps occurring due to the triggering of a protection element 11 are immediately closed by the redundantly arranged replacement protection element 12.

As the representation in FIG. 2 also reveals, the vehicle 1 has on the roof a number of sensors 4, which serve for monitoring the surrounding area and detecting in good time a missile approaching the vehicle 1. If a missile is detected by means of the sensors 4, which may for example be so-called "tracking-radar" elements, certain regions of the protection arrangement 10 or protection elements 11 provided in certain regions of the protection arrangement may be activated. The other regions of the protection arrangement 10 may remain in an inactive state. If, for example, a missile that is approaching the vehicle 1 from the front of the vehicle is detected by means of the sensors 4, the protection elements 11 arranged in the region of the front of the vehicle may be activated. The other protection elements 11 may remain in an inactive state, which significantly reduces the risk of unwanted instances of triggering of the protection elements 11, for example by the target being fired on by snipers or similar effects. As soon as the missile has then approached the vehicle 1 or the protection equipment 10 to the extent that it penetrates the region underneath the projection Ü, the protection element 11 lying above that is triggered and destroys the missile. The remaining fragments of the missile are intercepted by way of the basic armor plating of the vehicle 1. Immediately after triggering of the protection element 11, the protection element 12 lying behind it is transformed into its active state, so that the gap occurring due to triggering of the protection element 11 is immediately closed.

Figure 3:
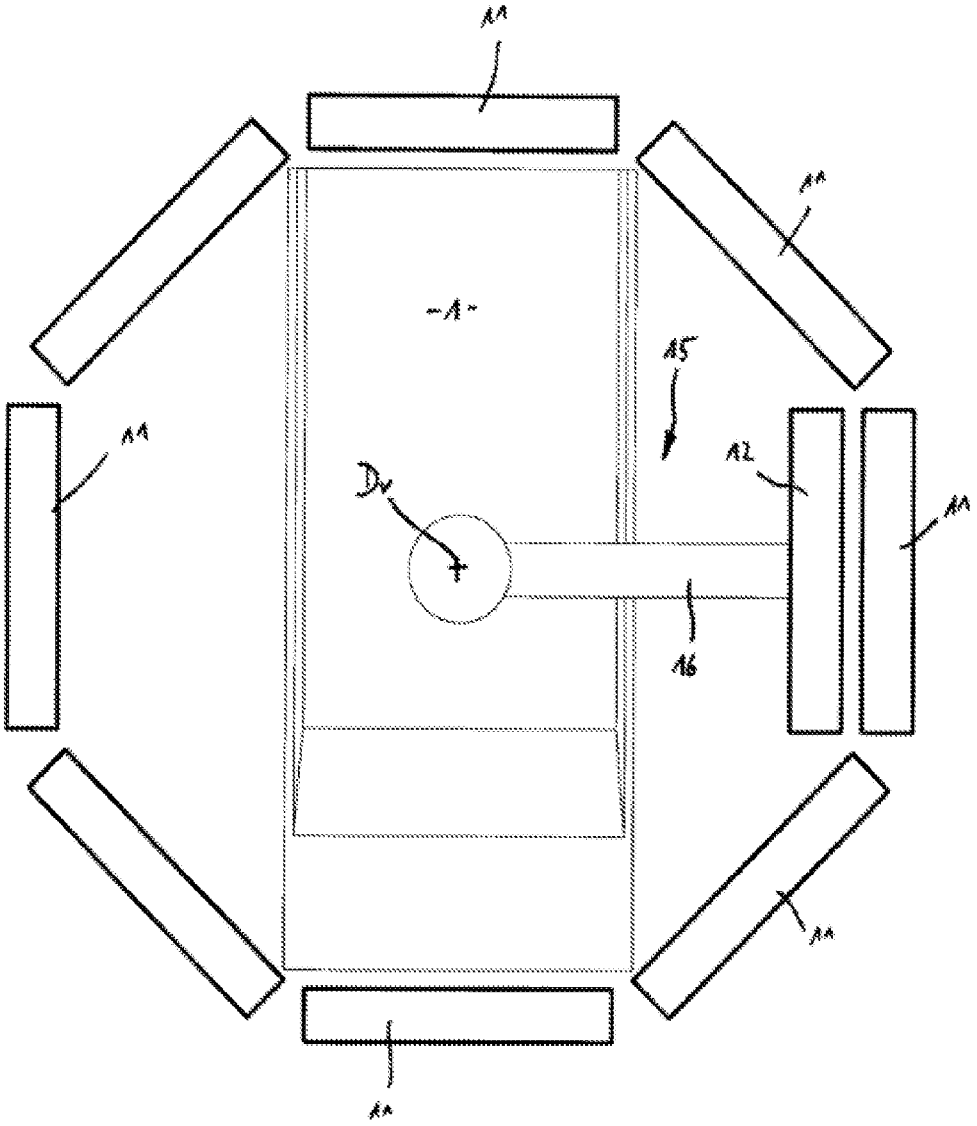
FIG. 3 shows a top plan view to illustrate an alternative arrangement of the protection equipment.

FIG. 3 shows an alternative design of the protection arrangement 10, in which the outer protection elements 11 are fixedly arranged. Provided movably with respect to the fixed protection elements 11 is a replacement protection element 12, which can be respectively brought into a position behind a triggered protection element 11 by way of moving means 15, in order thereby to close the gap occurring after triggering of the protection element 11. An advantage of this design is that various protection elements 11 can be replaced by a single replacement protection element 12, which reduces the number of replacement protection elements 12 required altogether.

The means 15 for moving the protection element 12 comprise a rotatably mounted cantilever arm 16, which is articulated in the roof region of the vehicle 1 about a substantially vertically extending axis of rotation $D_V$. On the cantilever arm 16 there may also be arranged more than one replacement protection element 12. For example, two or four replacement protection elements 12 may be arranged on the cantilever arm 16. It is also conceivable to form a complete protective ring on the cantilever arm 16, in this case the number of replacement protection elements 12 corresponding to the number of outer protection elements 11. In this way, quadruple redundancy would then be obtained, on account of the possibility of movement of the inner ring of replacement protection elements 12.

Figure 4:
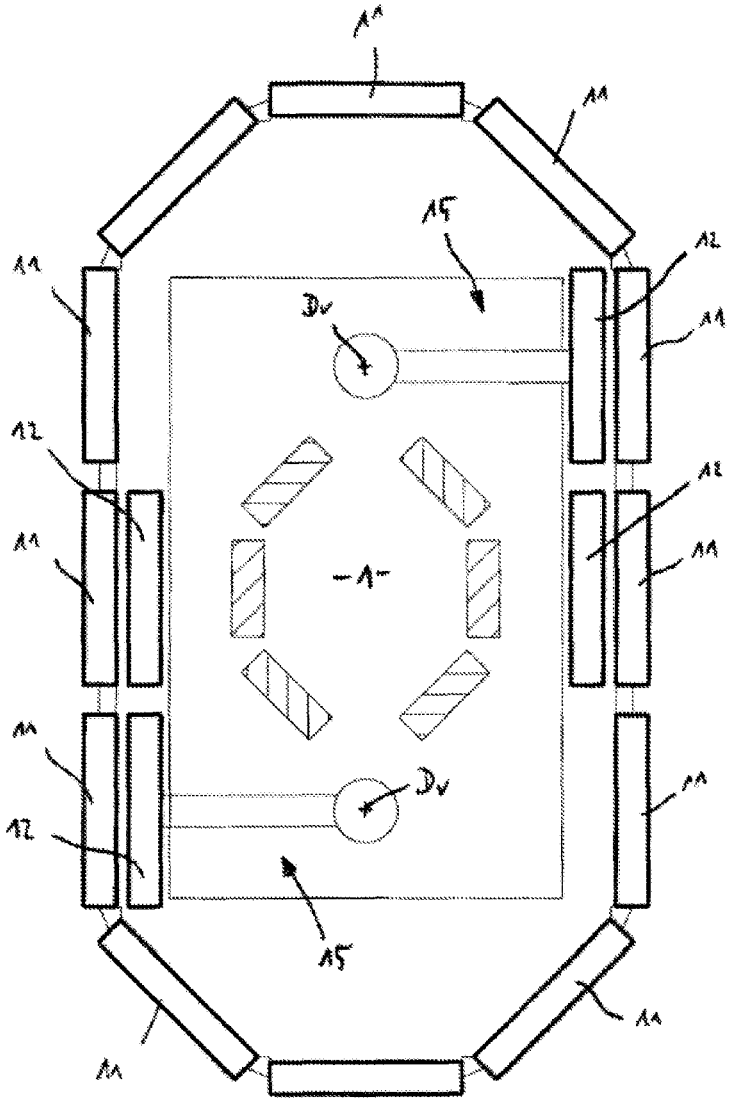
FIG. 4 shows a top plan view to illustrate a further alternative arrangement of the protection equipment.

FIG. 4 shows a further design, in which both replacement protection elements 12 that are fixed and replacement protection elements 12 that are arranged movably by way of moving means 15 are provided. An advantage of this construction is that, in the case of relatively long vehicles 1, the protection equipment 10 does not extend too far beyond their side surface, whereby loading dimensions can be maintained. In the front and rear regions of the vehicle 1, moving means 15 are respectively arranged with a replacement protection element 12 in a way corresponding to the representation in FIG. 3. In the middle region of the vehicle 1, which is not readily accessible for the moving means 15, two fixed protection elements 12 are provided in the case of the exemplary embodiment. It is also possible, however, for more fixed replacement protection elements 12 to be provided.

While the designs described above have respectively showed versions of protection equipment 10 in which the replacement protection elements 12 are arranged in a position behind the triggered protection element 11, the representations in FIGS. 5 to 8 respectively show versions of protection equipment 10 in which the replacement protection element 12 assumes the position of the triggered protection element 11 after its release.

Figure 5:
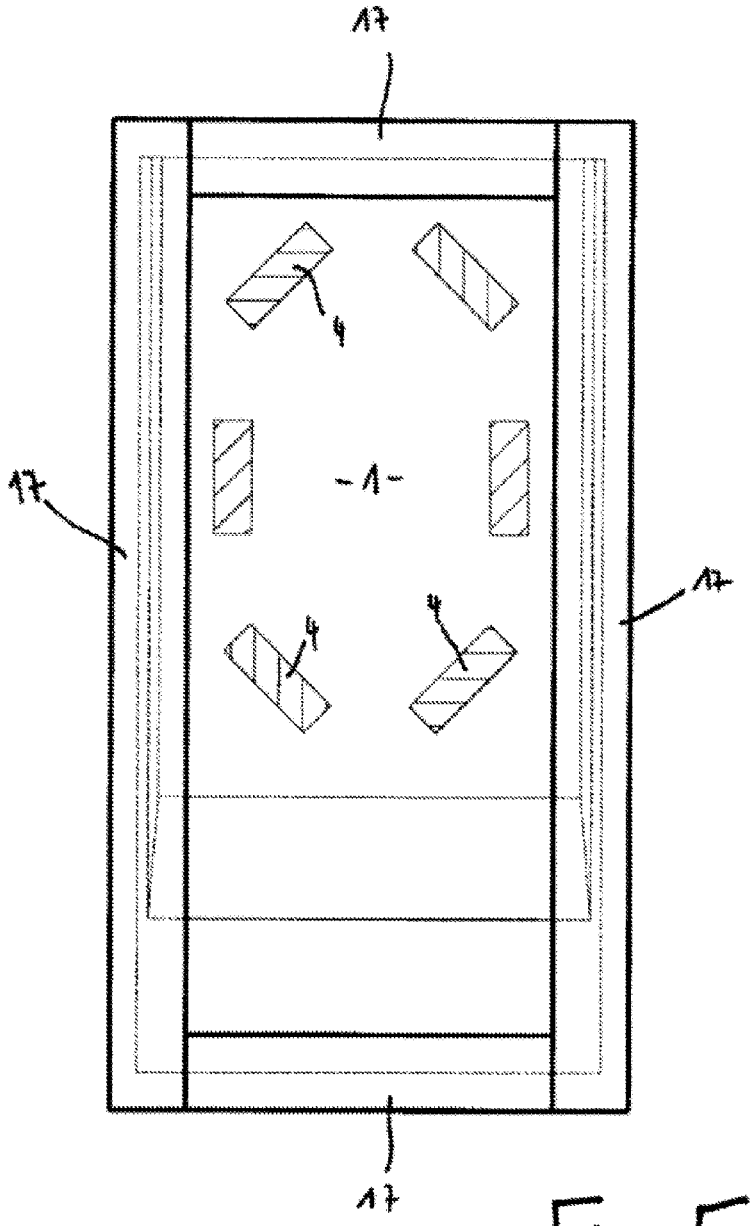
FIG. 5 shows a top plan view to illustrate a further alternative arrangement of the protection equipment.
Figure 6:
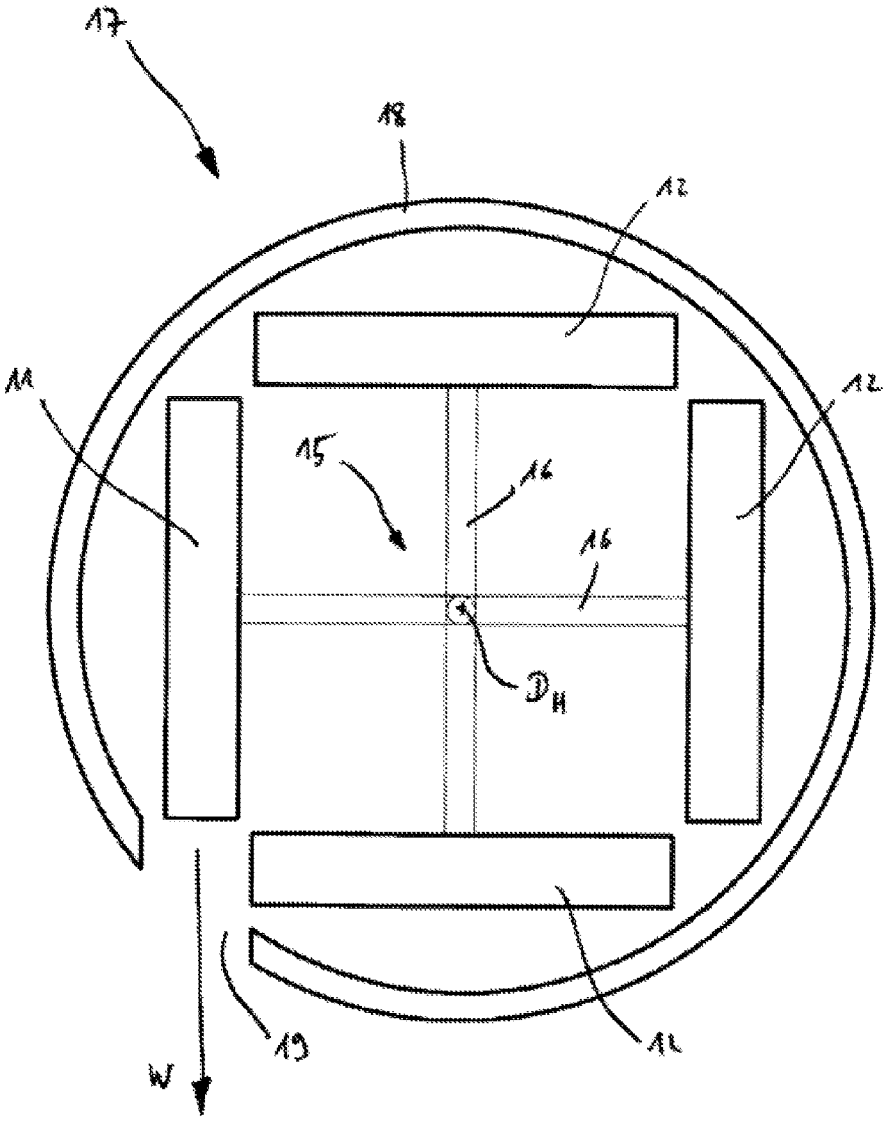
FIG. 6 shows a side view of part of the protection equipment shown in FIG. 5.

In FIG. 5 there is firstly depicted a design in which a number of rotary drums 17 are arranged in the region of the roof 2 of the vehicle 1, likewise in the manner of a protective ring. The construction of the rotary drums 17 is reproduced in FIG. 6 in a schematic side view. The rotary drums 17 are formed in the manner of a revolver magazine and have inside a moving means 15, which is a construction with altogether four protection elements 11, 12 that is rotatable about a horizontal axis of rotation $D_H$. According to the representation in FIG. 6, the protection element 11 is in a position above an active opening 19, from which the protection element 11 can be triggered, and thereby produces in the direction of effect W an effect in the direction of a missile to be combated.

As soon as the protection element 11 has been triggered, the replacement protection elements 12 arranged redundantly in relation to it can be transferred into its position. For this purpose, the drum magazine is turned by 90 degrees by way of the moving means 15, so that then a replacement protection element 12 takes the place of the triggered protection element 11. Incremental turning provides a triply redundant arrangement.

FIG. 7 shows a design in which the protection elements 11, 12 are arranged within a magazine. The protection element 11 at the front in FIG. 7 is in its protective position. After triggering of the protection element 11, the replacement protection elements 12 lying behind it can be transferred into the position of the triggered protection element 11 and take over its function. When triggering takes place, the triggered protection element 11 comes away from the magazine 20, so that the replacement protection element 12 arranged behind it can be brought into the forward position by way of guiding elements 21. Provided for this purpose are schematically depicted springs 22, which automatically transfer the replacement protection element 12 into the forward end position.

FIG. 8 also shows a magazine 20 with a number of protection elements 11, 12. With this magazine, the replacement protection element 12 is transferred into the position of the triggered protection element 11 in a folding movement, and possibly an additional axial movement. The advantage of this design is that, when the triggering of the protection element 11 takes place, the replacement protection elements 12 are arranged in a folded-up position, so that they cannot be adversely affected by the triggering of the protection element 11.

With the versions of protective equipment 10 described above it is possible to obtain reliable protection of a target 1 even against multi-hits from the same direction, since a triggered protection element 11 is replaced immediately by a replacement protection element 12 provided for it. No gaps in the protection occur, whereby the overall protection of the target 1 is improved.

TABLE I

REFERENCE NUMERALS

1 Target, vehicle
2 Vehicle roof
3 Holder
4 Sensor
10 Protection equipment
11 Protection element
12 Replacement protection element
15 Moving means
16 Cantilever arm
17 Rotary drum
18 Covering
19 Active opening
20 Magazine
21 Guiding element
22 Spring
23 Hinge
W Direction of effect
A Distance
Ü Projection
$D_V$ Vertical axis of rotation
$D_H$ Horizontal axis of rotation

What is claimed is:

1. Protection equipment for protecting a target against attacking missiles, the protection equipment comprising:

a plurality of protection elements comprising a plurality of replacement protection elements, wherein each of the protection elements is triggered individually to combat a missile;

wherein each of the protection elements is arranged such that a triggered protection element is replaced by at least one of the plurality of replacement protection elements;

wherein at least one of the plurality of replacement protection elements is arranged behind the triggered protection element; and wherein at least one of the plurality of replacement protection elements is fixedly arranged, and at least one of the plurality of replacement protection elements is movably arranged.

2. The protection equipment of claim 1, wherein the plurality of protection elements is arranged such that a direction of an effect of the plurality of protection elements is directed toward the earth.

3. The protection equipment of claim 1, wherein the plurality of protection elements is arranged in a form of a ring.

4. The protection equipment of claim 1, wherein the plurality of protection elements comprises a plurality of explosive charges, the plurality of explosive charges comprising at least one of a hollow charge, a plane charge, a cutting charge, and a projectile-forming charge, and wherein the plurality of explosive charges is configured to be triggered together.

5. The protection equipment of claim 1, wherein at least one of the plurality of protection elements comprises an assigned replacement protection element and comprises a replacement protection element configured to selectively replace a triggered protection element disposed at any one of a plurality of positions.

6. The protection equipment of claim 1, wherein at least one of the plurality of protection elements is fixedly arranged and at least one of the plurality of replacement protection elements is movably arranged.

7. The protection equipment of claim 6 further comprising a means for moving the at least one of the plurality of replacement protection elements.

8. The protection equipment of claim 1, wherein, when providing a replacement, the replacement one of the replacement protection elements assumes a position of the triggered one of the protection elements.

9. The protection equipment of claim 1, further comprising a magazine; and wherein the triggered protection element and the at least one of the plurality of replacement protection elements are disposed in the magazine.

10. The protection equipment of claim 9, wherein the at least one of the plurality of replacement protection elements is configured to translate from a rearward position of the magazine to a forward position of the magazine.

11. A vehicle, comprising:

the protection equipment of claim 1.

12. The vehicle of claim 11, wherein the protection equipment is arranged on a roof of the vehicle.

13. A method for protecting a target against attacking missiles with protection equipment, the method comprising:

replacing a triggered protection element by a replacement protection element arranged redundantly in relation to the triggered protection element on a vehicle;

wherein the protection equipment comprises the protection equipment of claim 1.

14. The method of claim 13, further comprising:

triggering a protection element.

15. Protection equipment for protecting a target against attacking missiles, the protection equipment comprising:

a plurality of protection elements, wherein each of the plurality of protection elements is triggered individually to combat a missile; and a rotary drum, comprising a covering and an active opening;

wherein each of the plurality of protection elements is arranged such that a triggered one of the protection elements is replaced by a replacement one of the protection elements, the replacement one of the protection elements being arranged redundantly in relation to the triggered one of the protection elements;

wherein at least one of the plurality of protection elements is arranged in the rotary drum; and wherein the rotary drum is rotatable about a horizontal axis of rotation.

* * * * *